US010081201B2

(12) United States Patent
Kandelaars et al.

(10) Patent No.: US 10,081,201 B2
(45) Date of Patent: Sep. 25, 2018

(54) PRINTING SYSTEM FOR CUT SHEETS COMPRISING A PAPER PATH WITH A LOOP

(71) Applicant: Océ-Technologies B.V., Venlo (NL)

(72) Inventors: Jacobus J. Kandelaars, Venlo (NL); Patrick G. H. Vestjens, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/594,047

(22) Filed: May 12, 2017

(65) Prior Publication Data

US 2017/0246888 A1 Aug. 31, 2017

Related U.S. Application Data

(63) Continuation of application No. PCT/EP2015/076906, filed on Nov. 18, 2015.

(30) Foreign Application Priority Data

Nov. 21, 2014 (EP) ..... 14194335

(51) Int. Cl.
*B41J 13/00* (2006.01)
*G03G 15/00* (2006.01)

(52) U.S. Cl.
CPC ..... *B41J 13/0009* (2013.01); *G03G 15/5029* (2013.01); *G03G 15/5062* (2013.01); *G03G 15/5083* (2013.01); *G03G 2215/00599* (2013.01)

(58) Field of Classification Search
None
See application file for complete search history.

(56) References Cited

U.S. PATENT DOCUMENTS

2009/0268261 A1* 10/2009 Banton ..... H04N 1/00002 358/474
2014/0240381 A1 8/2014 Fujimoto

FOREIGN PATENT DOCUMENTS

EP 2 159 067 A2 3/2010

OTHER PUBLICATIONS

IP.com search.*

(Continued)

*Primary Examiner* — Lisa M Solomon
(74) *Attorney, Agent, or Firm* — Birch, Stewart, Kolasch & Birch, LLP

(57) ABSTRACT

The present invention relates to a printing system for printing a plurality of sheets having different media properties, and a paper path comprising a loop in order to enable printing on the plurality of sheets in an interweaving first and second pass in the loop, and a print engine for disposing marking material on the sheets according to the image data. The print system comprises a pattern recognition module for recognizing a repeating pattern in the plurality of sheets on the basis of the media properties of the sheets. The control unit is configured to determine the entrance time of each of the plurality of sheets for entering the loop in the paper path for the first pass and for the second pass while taking the repeating pattern recognized by the pattern recognition module and a length of the loop into account.

8 Claims, 5 Drawing Sheets

(56) References Cited

OTHER PUBLICATIONS

International Search Report, issued in PCT/EP2015/075906 (PCT/ISA/210), dated Jan. 26, 2016.
Written Opinion of the International Searching Authority, issued in PCT/EP2015/076906 (PCT/ISA/237), dated Jan. 26, 2016.

* cited by examiner

PRINTING SYSTEM FOR CUT SHEETS COMPRISING A PAPER PATH WITH A LOOP

CROSS REFERENCE TO RELATED APPLICATIONS

This application is a Continuation of PCT International Application No. PCT/EP2015/076906, filed on Nov. 18, 2015, which claims priority under 35 U.S.C. 119(a) to patent application Ser. No. 14/194,335.7, filed in Europe on Nov. 21, 2014, all of which are hereby expressly incorporated by reference into the present application.

FIELD OF THE INVENTION

The present invention relates to a printing system for cut sheets, the printing system comprising a control unit for controlling the printing of image data on a plurality of sheets and scheduling the plurality of sheets in a printing order, the plurality of sheets having different media properties, a paper path comprising a loop in order to enable printing on the plurality of sheets in an interweaving first and second pass in the loop, each of the plurality of sheets having an entrance time in the loop for the first pass, and a print engine for disposing marking material on the sheets according to the image data.

BACKGROUND OF THE INVENTION

According to the paper path of a printing system each of the plurality of sheets is transported from an input section of the printing system towards a print head or print assembly. By means of the print head or print assembly marking material is disposed on each of the plurality of sheets. Each of the plurality of sheets is transported from the print head or print assembly towards an output section of the printing system. To enable duplex printing the paper path contains a loop, a so-called duplex loop. A sheet enters the loop in a first pass in order to print image data on one side of the sheet, goes through the duplex loop and enters the duplex loop in a second pass in order to print image data on the other side of the sheet. However, simplex printing—printing on one side of a sheet—may also be executed with a loop in the paper path for interweaving a first and second pass. Such a loop will be called a simplex loop. The present invention relates to a simplex loop as well as to a duplex loop. A print engine with a loop may have a print speed of twice as high as a speed of a separation in the input module and a working speed of an output module or finisher. In such a case the loop may be used to print on the plurality of sheets by interweaving the plurality of sheets in the first pass and in the second pass.

A problem arises when scheduling the plurality of sheets which have different media properties. A media property of a sheet may be a size, a weight, a thickness, a color, a fibre structure, transparency, a media type, etc. The printing system therefore has different timing constraints in the print engine for each kind of sheet having different media properties. Such a timing constraint may be a set up time for a prescribed distance of the print head or print assembly to the sheets which distance may be different for each kind of a sheet. The kind of sheet is determined by the media properties of the sheet.

It is an objective of the present invention to provide a printing system that permits to increase productivity of the printing system with regard to scheduling the plurality of sheets having different media properties.

SUMMARY OF THE INVENTION

In order to achieve this objective, according to the present invention, the printing system comprises a pattern recognition module for recognizing a repeating pattern in the plurality of sheets on the basis of the media properties of the sheets, and the control unit is configured to determine an entrance time of each of the plurality of sheets for entering the loop in the paper path for the first pass and to determine an entrance time of each of the plurality of sheets for entering the loop in the paper path for the second pass while taking the repeating pattern recognized by the pattern recognition module and a length of the loop into account.

By doing so a repeating pattern of the different media properties of the sheets to be planned is recognized and this information is used to schedule the sheets near to optimal. The scheduling of the timing of a sheet entering the loop for the first pass may also determine the scheduling of the timing of the same sheet entering the loop for the second pass. The timing of the sheets is scheduled in such a way that an occurrence of the recognized repeating pattern in the plurality of sheets is coinciding when entering the loop in the first pass with another occurrence of the recognized repeating pattern in the plurality of sheets when entering the loop in the second pass. By the coincidence of the repeating patterns timing constraints are diminished.

For example, if a sequence of booklets having a cover sheet and a plurality of body sheets has to be printed, a second pass of a cover of a first booklet may be combined with a first pass of a cover of the third booklet. In this manner all body sheets of the first booklet in the second pass are interleaved with all body sheets of the third booklet in the first pass. It is assumed that the loop has such a length that sheets of at least two booklets may be simultaneously scheduled in the loop. Because of a set up time, the distance in time between a cover sheet and the first body sheet of a booklet is significantly larger than between body sheets of the booklet. In a first example the recognized pattern comprises identifiers CBBBBBBB wherein the identifier C represents the first sheet of the booklet and the identifier B represents a body sheet of the booklet. The first sheet of the booklet has different media properties than a body sheet of the booklet. By scheduling the entrance times of the first sheets of different occurrences of the booklet adjacent to each other in the first and second pass as described hereabove, the significantly larger distance in time between a first sheet and the first body sheet has to be dealt with only once per two cover sheets from different occurrences of the booklet. In a second example the recognized pattern comprises identifiers CBBBBBBBC wherein the identifier C represents the cover sheet of the booklet and the identifier B represents a body sheet of the booklet. The cover sheet of the booklet has different media properties than a body sheet of the booklet. By scheduling the entrance times of the cover sheets of different occurrences of the booklet adjacent to each other in the first and second pass as described hereabove, the significantly larger distance in time between a cover sheet and the first body sheet has to be dealt with only once per four cover sheets from different occurrences of the booklet.

The interleaving of occurrences of the same pattern at the entrance of the loop is determined by taking the length of the loop into account. In the first pass of a first occurrence of a recognized pattern room is reserved between the sheets to interleave with sheets of a subsequent occurrence of the pattern. The combination of the occurrences may be in an overtake mode or in a delay mode. In the overtake mode a second pass sheet of a first occurrence of the pattern is placed directly before the corresponding first pass sheet of a second occurrence of the pattern. In the delay mode the second pass sheet of the first occurrence is placed directly after the corresponding first pass sheet of the second occurrence of the pattern.

The present invention has been explained here-above in the example of a booklet with a cover and a body but the present invention holds for all repeating patterns in a plurality of sheets. Repeating patterns may be detected in a plurality of sheets comprised in one print job, across the sets of the one print job or across a plurality of print jobs which are consecutively scheduled in the print job queue of the printing system.

According to an embodiment the printing system comprises at least one input holder for holding the plurality of sheets and the control unit is configured to determine the entrance time of each of the plurality of sheets for entering the loop in the paper path for the first pass by determining for each of the plurality of sheets the moment in time of separation of the sheet from the at least one input holder.

According to an embodiment the paper path comprises at least one buffer section in the loop in which buffer section the velocity of the sheets is changeable with respect to the remaining part of the paper path and the control unit is configured to determine the entrance time of each of the plurality of sheets for entering the loop in the paper path for the second pass by determining for each of the plurality of sheets a change in the velocity of the sheet when entering the at least one buffer section. The change of velocity in the buffer part may vary with respect to the media properties of the sheet.

According to an embodiment the pattern recognition module is configured to detect at least one tandem repeat in the plurality of sheets. The repeating pattern consists of one or more tandem repeats. Tandem repeats occur in a queue of tokens when a pattern of one or more tokens is repeated and the repetitions are directly adjacent to each other. The inventors have found the use of tandem repeats applicable to the recognition of repeating patterns in the media properties of the plurality of sheets to be printed.

According to an embodiment the pattern recognition module is configured to recognize a number of groups of media properties which number is limited to an expected number of different groups of media properties of sheets to be printed by the printing system. The expected number may be in a range of five plus or minus two. The pattern recognition module may be configured to stop the recognition if the expected number is exceeded since this may result in a poor schedule.

According to an embodiment the pattern recognition module is configured to receive a number of sheets in print order to be time scheduled which number is at least twice the maximum number of sheets which fits in the loop. This is sufficient to recognize a consecutive repeating pattern.

The present invention also relates to a method for time scheduling a plurality of sheets having different media properties in a loop of a printing system which comprises a control unit for controlling the printing of image data on the plurality of sheets and scheduling the plurality of sheets in a printing order, and a paper path comprising the loop in order to enable printing on the plurality of sheets in an interweaving first and second pass in the loop, and a print head or print assembly for disposing marking material on the sheets according to the image data, wherein the method comprises the steps of recognizing a repeating pattern in the plurality of sheets on the basis of the media properties of the sheets, determining an entrance time of each of the plurality of sheets for entering the loop in the paper path for the first pass while taking the repeating pattern recognized by the pattern recognition module and a length of the loop into account, and printing the image data on the plurality of sheets in a first pass and a second pass through the loop, wherein each of the plurality of sheets enters the loop in the paper path for the first pass at the determined entrance time.

The present invention also relates to a software product comprising program code on a non-transitory computer-readable medium, wherein said program code, when loaded into a computer that is connected to a printing system according to the present invention causes the computer to act according to a method of the present invention.

BRIEF DESCRIPTION OF THE DRAWINGS

Preferred embodiments will now be described in conjunction with the drawings, wherein.

DETAILED DESCRIPTION OF PREFERRED EMBODIMENTS

Figure 1:
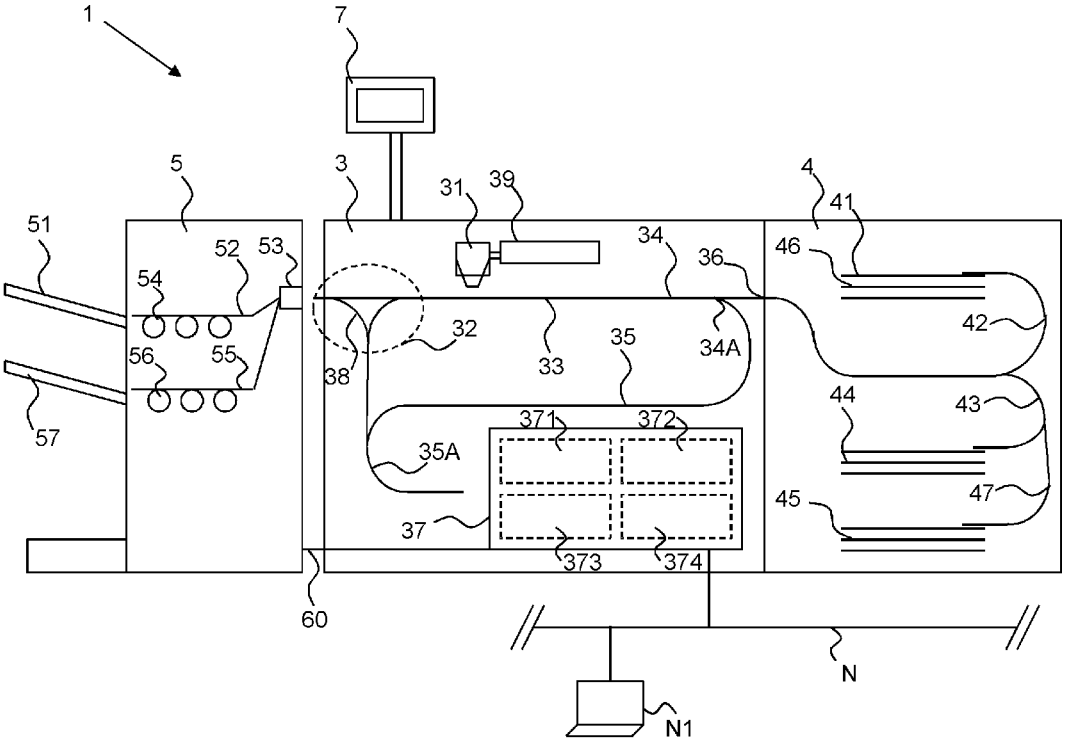
FIG. 1 is a schematic view of the printing system according to the present invention.

FIG. 1 shows schematically an embodiment of a printing system 1 according to the present invention. The printing system 1, for purposes of explanation, is divided into an output section 5, a print engine and control section 3, a local user interface 7 and an input section 4. While a specific printing system is shown and described, the disclosed embodiments may be used with other types of printing system such as ink jet, electrographic, etc.

The output section 5 comprises a first output holder 52 for holding printed image receiving material, for example a plurality of sheets. The output section 5 may comprise a second output holder 55. The printed image receiving material is transported from the print engine and control section 3 via an inlet 53 to the output section 5. When a stack ejection command is invoked by the control unit 37 for the first output holder 52, first guiding means 54 are activated in order to eject the plurality of sheets in the first output holder 52 outwards to a first external output holder 51. When a stack ejection command is invoked by the control unit 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer.

The print engine and control section 3 comprises a print engine and a control unit 37 for controlling the printing process and scheduling the plurality of sheets in a printing order before they are separated from input holder 44, 45, 46.

The control unit 37 is a computer, a server or a workstation, connected to the print engine and connected to the digital environment of the printing system, for example a network N for transmitting a submitted print job to the printing system 1. In FIG. 1 the control unit 37 is positioned inside the print engine and control section 3, but the control unit 37 may also be at least partially positioned outside the print engine and control section 3 in connection with the network N in a workstation N1.

The control unit 37 comprises a print job receiving section 371 permitting a user to submit a print job to the printing system 1, the print job comprising image data to be printed and a plurality of print job settings. The control unit 37 comprises a print job queue section 372 comprising a print job queue for print jobs submitted to the printing system 1 and scheduled to be printed. The control unit 37 comprises a pattern recognition section 373 comprising a pattern recognition module according to the present invention. The control unit 37 comprises a sheet scheduling section 374 for determining for each of the plurality of sheets of the print jobs in the print job queue an entrance time in the paper path of the print engine and control section 3, especially an entrance time for the first pass and an entrance time for the second pass in the loop in the paper path according to the present invention. In the determination of the entrance time of each sheet for the first pass and the second pass in the loop, the sheet scheduling section 374 takes a recognized pattern of the plurality of sheets by the pattern recognition section 373 and the length of the loop into account. The length of the loop corresponds to a loop time duration of a sheet going through the loop depended on the velocity of the sheets in the loop. The loop time duration may vary per kind of sheet, i.e. a sheet with different media properties.

The loop time duration may also vary due to the use of a buffer part in the loop in which buffer part the velocity of the sheet may decrease or increase with respect to the rest of the loop.

Resources may be recording material located in the input section 4, marking material located in a reservoir 39 near or in the print head or print assembly 31 of the print engine, or finishing material located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the present invention. The loop enables the printing of a duplex print job and/or a mix-plex job, i.e. a print job comprising a mix of sheets intended to be printed partially in a simplex mode and partially in a duplex mode.

The print head or print assembly 31 is suitable for ejecting and/or fixing marking material to image receiving material. The print head or print assembly 31 is positioned near the paper path section 34. The print head or print assembly 31 may be an inkjet print head, a direct imaging toner assembly or an indirect imaging toner assembly.

While an image receiving material is transported along the paper path section 34 in a first pass in the loop, the image receiving material receives the marking material through the print head or print assembly 31. A next paper path section 32 is a flip unit 32 for selecting a different subsequent paper path for simplex or duplex printing of the image receiving material. The flip unit 32 may be also used to flip a sheet of image receiving material after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the loop. The sheets coming from the paper path section 35 are starting their second pass along the print head or print assembly 31 in the loop. When a sheet has passed the print head or print assembly 31 for the second time in the second pass, the sheet is transported to the inlet 53 of the output section 5.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to an outlet 36 for entrance in the print engine and control section 3. Each input holder 44, 45, 46 may be used for holding a different kind of image receiving material, i.e. sheets having different media properties.

The local user interface 7 is suitable for displaying user interface windows for controlling the print job queue residing in the control unit 37. In another embodiment a computer N1 in the network N has a user interface for displaying and controlling the print job queue of the printing system 1.

Figure 2:
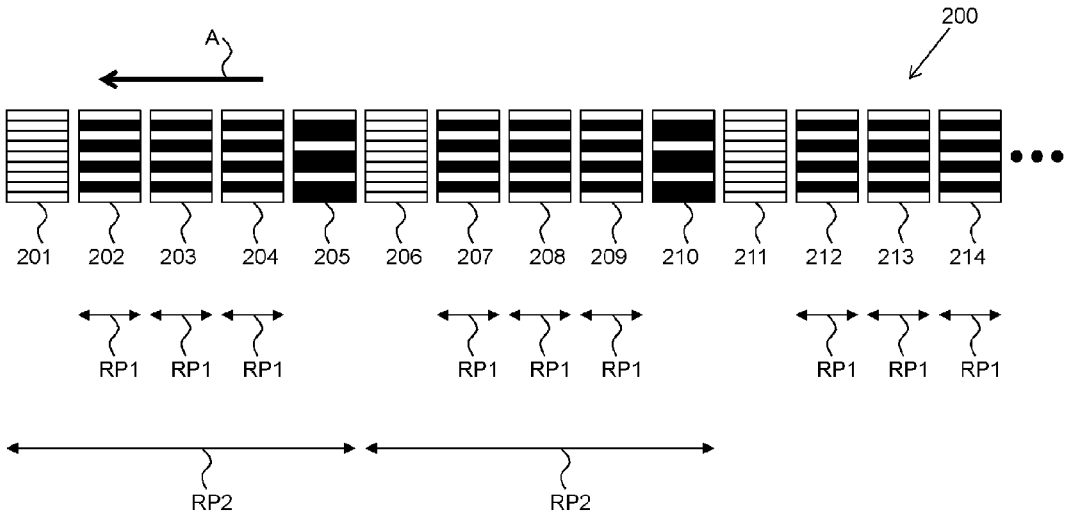
FIG. 2 is a schematic view of a list of scheduled sheets having different media properties and comprising repeated patterns according to the present invention.

FIG. 2 shows an embodiment of classifying the plurality of sheets according to their media properties. The plurality of sheets 201-214 is schematically displayed in a sheet list 200 according to a print order in which the sheets are intended to be deposited in the at least one of the output holders 52, 55. The plurality of sheets is moving in a direction A in the paper path of the printing system. When moving forward in the direction A each sheet will eventually encounter the print head or print assembly for printing image data on the sheet. The media properties of each sheet 201-214 is visualized in FIG. 2 by a type of hatching of the sheet. A first group of media properties of sheets 201, 206 and 211 are the same. A second group of media properties of sheets 202, 203, 204, 207, 208, 209, 212, 213, and 214 are the same. A third group of media properties of sheets 205 and 210 are the same.

The pattern recognition module is invoked to recognize repeating patterns in the plurality of sheets 201-214. A consecutive repeating pattern consists of one or more tandem repeats. Tandem repeats occur in the sheet list in FIG. 2 when a pattern of one or more hatchings is repeated and the repetitions are directly adjacent to each other. The tandem repeats are usually used in a DNA research to recognize common sequences of base pairs.

The pattern recognition module has recognized a first repeating pattern RP1 and a second repeating pattern RP2.

The first repeating pattern RP1 comprises a single sheet having media properties according to the second group. The first repeating pattern RP1 is repeated three times. A first occurrence of the first repeating pattern RP1 is a group of three sheets 202, 203, 204. A second occurrence of the first repeating pattern RP1 is a group of three sheets 207, 208, 209. A third occurrence of the first repeating pattern RP1 is a group of three sheets 212, 213, 214. The group of two sheets 202, 203 is a tandem repeat. The group of two sheets 203, 204 is a tandem repeat. The group of two sheets 207, 208 is a tandem repeat. The group of two sheets 208, 209 is a tandem repeat. The group of two sheets 212, 213 is a tandem repeat. The group of two sheets 213, 214 is a tandem repeat.

The second repeating pattern RP2 comprises five consecutive sheets. A first sheet of the five consecutive sheets has media properties according to the first group. A second, third and fourth sheet of the five consecutive sheets have media properties according to the second group. A fifth sheet of the five consecutive sheets has media properties according to the third group. The second repeating pattern RP2 is repeated at least twice.

A first occurrence of the second repeating pattern RP2 is a group of five sheets 201, 202, 203, 204, 205. A second occurrence of the second repeating pattern RP2 is a group of five sheets 206, 207, 208, 209, 210. The group of ten sheets 201-210 is a tandem repeat.

According to an embodiment the number of different groups of media properties is limited to a maximum out of a range of five plus or minus two in order to limit the pattern recognition processing time. It is assumed that within the scope of the known future groups of media properties the number of different groups of media properties will rarely exceed the selected maximum. The pattern recognition module may be stopped from execution at the moment that the number of groups of media properties exceeds the selected maximum.

According to an embodiment the number of sheets of which the print order is known is at least twice the maximum number of sheets which fits in the loop. This is sufficient to recognize a consecutive repeating pattern. If for example the maximum number of sheets that fits into the loop is 36, 72 future sheets with their media properties have to be known and already listed in their future printing order.

According to an embodiment the list of future sheets is transformed into a suffix tree in order to recognize a consecutive repeating pattern. The suffix tree is traversed with an algorithm based on an algorithm according to an article by Jens Stoye and Dan Gusfield from 1998, titled "Simple and flexible detection of contiguous repeats using a suffix tree", to find all occurrences of tandem repeats. The tandem repeats starting at the first sheet in the list are candidates for the consecutive repeating pattern. According to an embodiment a longest consecutive repeating pattern is chosen and when equal in length the one consecutive repeating pattern is chosen with the shortest tandem repeats. This latter choice is advantageous since a short pattern is more easily to be fit in the loop than a long pattern.

Once a repeating pattern is recognized the scheduling section of the control unit is invoked to determine the entrance times of each sheet for the first pass in the loop. To determine the entrance times the repeating pattern is taken into account. Also the length of the loop, expressed in a number of sheets or in the loop time duration, is taken into account. The loop time duration will hereinafter also be called a loop timing.

Figure 3:
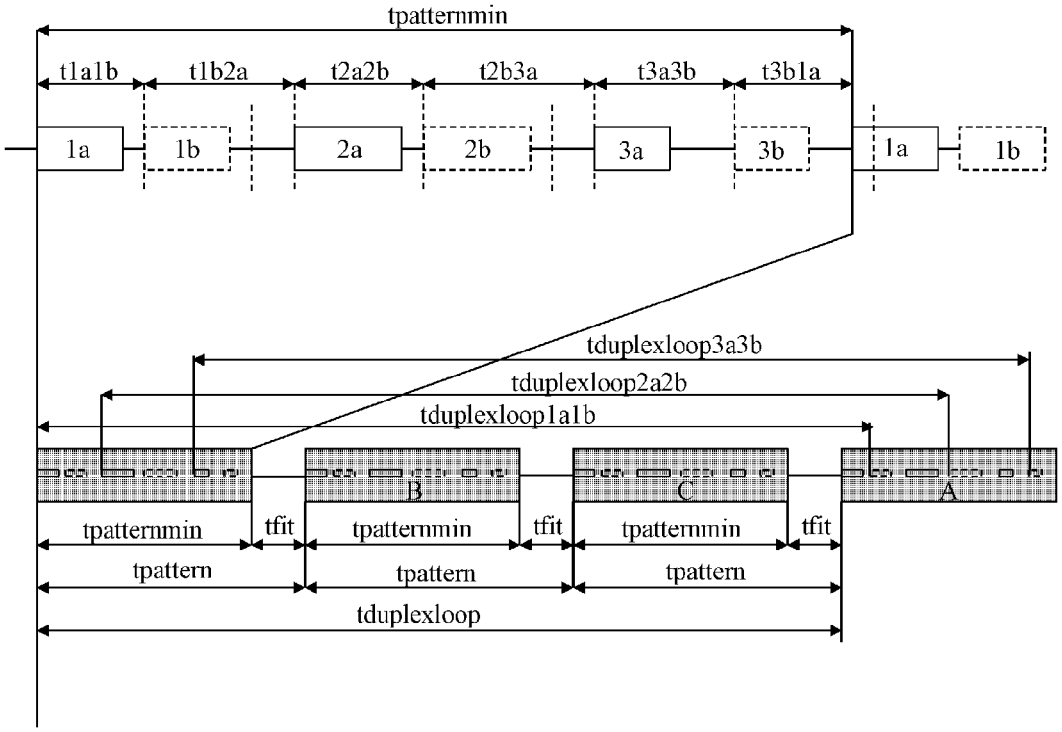
FIG. 3 is a schematic view of a determination of timings for at least one occurrence of a repeated pattern in the loop according to the present invention.

The entrance time of a sheet in the pattern is calculated and the entrance time of the sheets in the loop is calculated as shown in FIG. 3.

FIG. 3 shows a recognized repeating pattern of three sheets 1*a*, 2*a*, 3*a*, each sheet having different media properties: each sheet of the three sheets 1*a*, 2*a*, 3*a* has a different size.

Firstly the timings of the sheets in a recognized pattern are calculated. FIG. 3 gives an example of timings of a first occurrence of the recognized repeating pattern of three first pass sheets 1*a*, 2*a*, 3*a* and a second occurrence of the recognized repeating pattern of three second pass sheets 1*b*, 2*b*, 3*b*. The first occurrence of the pattern of three first pass sheets 1*a*, 2*a*, 3*a* is interleaved at the merging point 34A of the loop shown in FIG. 1 with the second occurrence of the same pattern of three second pass sheets 1*b*, 2*b*, 3*b*. A pattern timing $t_{patternmin}$ is the sum of interleave timings $t_{1a1b}$, $t_{2a2b}$, $t_{3a3b}$ of the first pass sheets 1*a*, 2*a*, 3*a* and timings $t_{1b2a}$, $t_{2b3a}$, $t_{3b1a}$ of the interleaved second pass sheets 1*b*, 2*b*, 3*b*. The pattern timing $t_{patternmin}$ is a minimum pattern timing since all timings have been selected to be minimally permitted timings of the first and second pass sheets 1*a*, 1*b*, 2*a*, 2*b*, 3*a*, 3*b*. Thus entrance times of timings $t_{1b2a}$, $t_{2a2b}$, $t_{3a3b}$ of the first pass sheets 1*a*, 2*a*, 3*a* and entrance times of the timings $t_{1b2a}$, $t_{2b3a}$, $t_{3b1a}$ of the interleaved second pass sheets 1*b*, 2*b*, 3*b* are minimized with respect to the different media properties of the plurality of sheets 1*a*, 2*a*, 3*a*, 1*b*, 2*b*, 3*b*. For example, a size of the pass sheet 1*a* is different from a size of the pass sheet 2*a*. This difference results in the interleave timing $t_{1a1b}$, for the pass sheet 1*a* which is different from the interleave timing $t_{2a2b}$, for the pass sheet 2*a*.

Set up times for each kind of sheet are part of the inter sheet timings corresponding to an inter sheet distance.

Secondly it is calculated how many times a minimum pattern timing $t_{patternmin}$ fits in a loop timing $t_{duplexloop}$. The loop timing is a timing which occurs when the whole loop is filled with occurrences of the repeated pattern.

The minimum pattern timing $t_{patternmin}$ is extended with a fitting timing $t_{fit}$ giving a pattern timing $t_{pattern}$ in order to fit the number of repeating patterns in the loop timing.

In this example, three pattern timings $t_{pattern}$ fit in the loop timing $t_{duplexloop}$. The loop contains three times six sheets equaling eighteen sheets. Each sheet, except the first sheet is shifted by one delay position to enable interleaving of the occurrences of the patterns at the merge point of the first and second pass in the loop. An algorithm has been developed by the inventors to find the pattern timing $t_{pattern}$ and the fitting timing $t_{fit}$ and will be explained by means of FIG. 4. Input for the algorithm are a minimum loop time and a maximum loop time for each sheet having different media properties. The minimum loop time $t_{xminduplexloop}$ and the maximum loop time $t_{xmaxduplexloop}$ are stored in storage of the control unit of the printing system for each sheet having a sheet number x. For each kind of sheet, i.e. a sheet having different media properties, a loop timing $t_{duplexloop1a1b}$, $t_{duplexloop2a2b}$, $t_{duplexloop3a3b}$ is determined. It is noted that due to the differences in media properties of each kind of sheet—for example the size of the sheet—the loop timings for each kind of sheet is different. The loop timing $t_{duplexloop}$ is a maximum of the minimum loop times $t_{xminduplexloop}$ over all the sheets. When such a loop timing is found, the fitting timing $t_{fit}$ may be zero. When such a loop timing cannot be found, the fitting timing $t_{fit}$ has to be larger than zero.

It is noted that a second pass sheet can be placed before a first pass sheet, i.e. in an overtake mode, or after a first pass sheet, i.e. in a delay mode. FIG. 3 shows a delay mode.

Figure 4:
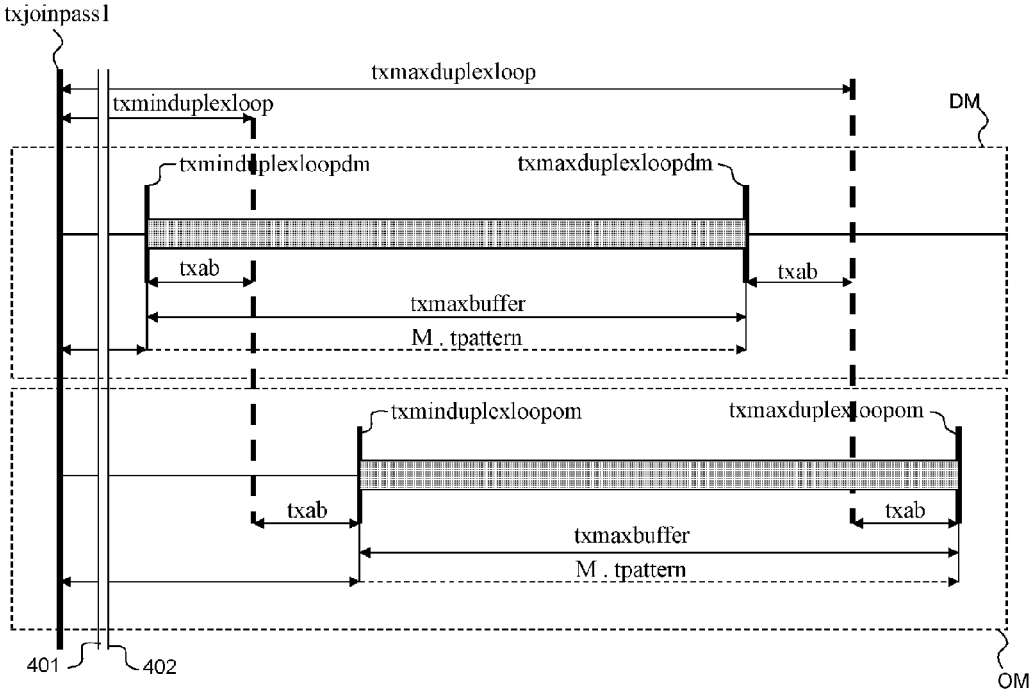
FIG. 4 is a schematic view of a determination of a buffer time for a sheet of the plurality of sheets according to the present invention.

FIG. 4 elucidates the delay mode DM and the overtake mode OM in further detail. Firstly it is investigated in the delay mode DM for every sheet×how many times (=M) the minimum pattern timing $t_{patternmin}$ fits into a range of loop timings from $t_{xminduplexloopdm}$ to $t_{xmaxduplexloopdm}$. A minimal M which is applicable for every sheet is taken. If there is such a number M a buffer time $t_{xbuffer}$ for each sheet is calculated and the productivity for that pattern is at maximum. The loop timing $t_{xminduplexloopdm}$ is the minimum time that a sheet needs to traverse the loop from join/merge point to join/merge point again. The loop timing $t_{xmaxduplexloopdm}$ is the maximum time that a sheet needs to traverse the loop from join/merge point to join/merge point again.

Secondly, if there is not such a number M for the delay mode DM the same algorithm as above with a range of loop timings from $t_{xminduplexloopom}$ to $t_{xmaxduplexloopom}$ is used in the overtake mode OM.

Thirdly, if there is not such a number M for the delay mode DM and for the overtake mode OM the number M is determined be getting an integer value of a division of the maximum loop time $t_{xminduplexloopdm}$ of all sheets by the minimum pattern time $t_{patternmin}$. M is equal to zero the pattern does not fit in the loop so there is no pattern scheduling possible. If the number M is not equal to zero the pattern time $t_{patternmin}$ is determined by the division of the maximum loop time $t_{xminduplexloopdm}$ of all sheets by the number M. The join pass time $t_{xjoinpass1}$ is the moment in time of the first pass of a sheet. The loop timing is truncated indicated by parallel vertical lines 401, 402. The timing is the time $t_{xab}$ needed for interleaving sheets from the first pass and the second pass.

The results of the calculations of all timings of the plurality of scheduled sheets are used in at least two parts of the paper path.

A first relevant part of the paper path is the input holder section 4 (See FIG. 1). Separation of the sheets from the input holders 44, 45, 46 is scheduled according to the calculations. This means that the separation moments are in line with the calculations for each of the plurality of scheduled sheets. A period of time between separation moments of two subsequent sheets in the list of the plurality of sheets in FIG. 2 may vary according to the calculations shown in FIG. 3 and FIG. 4. The calculated entrance timings of the sheets are transcribed into data signals to be submitted from the control unit to a separation mechanism of the input holders at the appropriate moments in time. A second relevant part of the paper path may be a buffer section in the paper path. The buffer section may be used to change the velocity of the sheets during their pass of the buffer section before entering the loop for the second pass arriving from paper path section 35 (See FIG. 1). The buffer section may be a part of the paper path section 35 between the sheet turning point 35A and the merge point 34A. The buffer section may be a part of the paper path between the flip unit 32 and the sheet turning point 35A. The buffer section may be a part of the paper path between the print head or print assembly 31 and the flip unit 32. The amount of the change in velocity may be determined by constraints of the printing system and tuned to an allowed buffer time which is also calculated according to FIG. 3 and FIG. 4. The change of the velocity may be an increase of the velocity or a decrease of the velocity. The amount of the change of the velocity is such that no jamming of sheets will occur in the paper path. The calculated entrance timings of the sheets and the buffer times of the sheets are transcribed into data signals to be submitted from the control unit to a velocity adjustment device being part of the buffer section in the paper path at the appropriate moments in time.

As long as the pattern is recognized in future pluralities of sheets the timings of the entrance of the sheets at the merge point 34A is applied according to the calculations according to the present invention and shown in FIG. 3 and FIG. 4. When the recognized pattern is no longer recognized in the future pluralities of sheets, the scheduling of the timings of the entrance of the future sheets is changed from the previous calculated entrance timings to entrance timings according to a default scheduling algorithm of the printing system.

As soon as the pattern recognition module recognizes a new pattern in the new sequences of sheets, calculations for timings are executed again and the scheduling of the incoming sheets is changed from the default scheduling to the newly calculated timings as long as the new pattern is recognized by the pattern recognition module, etc.

Figure 5:
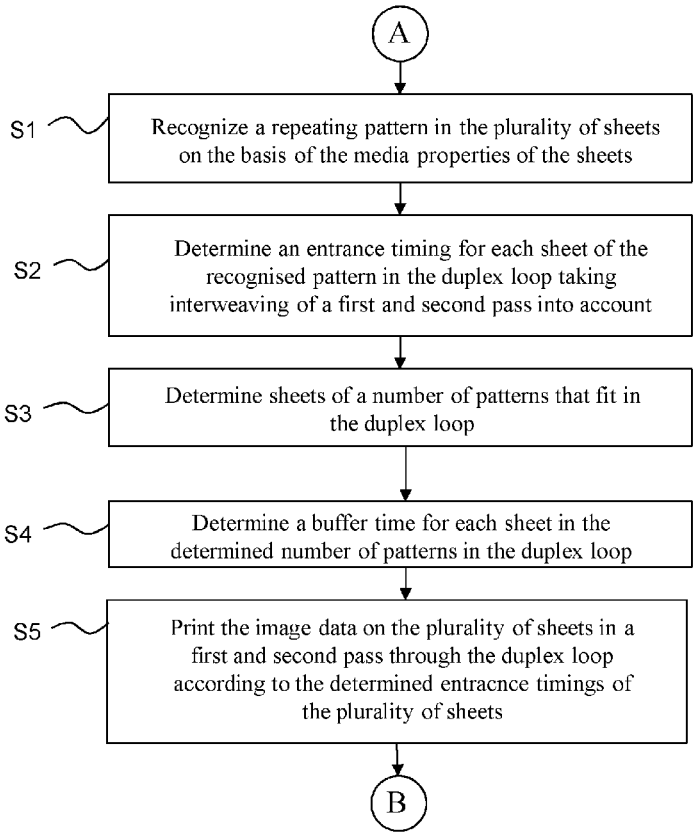
FIG. 5 is a flow diagram of an embodiment of the method according to the present invention.

FIG. 5 shows a flow diagram of an embodiment of the method according to the present invention. The method is suitable for time scheduling a plurality of sheets having different media properties in a loop of the printing system according to the present invention. The printing system comprises a control unit for controlling the printing of image data on the plurality of sheets and scheduling the plurality of sheets in a printing order, and a paper path comprising the loop in order to enable printing on the plurality of sheets in an interweaving first and second pass in the loop, and a print head or print assembly for disposing marking material on the sheets according to the image data. The method starts in starting point A and leads to a first step S1.

In the first step S1 a repeating pattern is recognized in the plurality of sheets on the basis of the media properties of the sheets.

In a second step S2 an entrance time of each of the sheets of one occurrence of the recognized pattern is determined for entering the loop in the paper path for the first pass and the second pass while taking the repeating pattern recognized by the pattern recognition module and the interweaving of a first pass and a second pass in the loop into account.

In a third step S3 a number of occurrences of the pattern is determined wherein the sheets of the determined number of occurrences fit in the loop.

In a fourth step S4 a buffer time is determined for each sheet in the determined number of occurrences of the pattern in the loop in the previous step S3.

In a fifth step S5 the image data is printed on the plurality of sheets in the first and second pass through the loop according to the determined entrance timings of the plurality of sheets.

The method ends in an end point B.

The skilled person will recognize that other embodiments are possible within the scope of the appended claims.

The invention claimed is:

1. A printing system for cut sheets, comprising:

a control unit for controlling the printing of image data on a plurality of sheets and scheduling the plurality of sheets in a printing order, the plurality of sheets having different media properties;

a paper path comprising a loop in order to enable printing on the plurality of sheets in an interweaving first and second pass in the loop;

a print engine for disposing marking material on the sheets according to the image data;

a pattern recognition module for recognizing an arbitrary repeating pattern in the plurality of sheets on the basis of the media properties of the sheets, wherein the control unit is configured to determine the entrance time of each of the plurality of sheets for entering the loop in the paper path for the first pass and for the second pass while taking the arbitrary repeating pattern recognized by the pattern recognition module and a length of the loop into account, and wherein the entrance time of each particular sheet of the plurality of sheets is minimized with respect to the media properties of the particular sheet.

2. The printing system according to claim 1, further comprising at least one input holder for holding the plurality of sheets, and wherein the control unit is configured to determine the entrance time of each of the plurality of sheets for entering the loop in the paper path for the first pass by determining for each of the plurality of sheets the moment in time of separation of the sheet from the at least one input holder.

3. The printing system according to claim 1, wherein the paper path comprises at least one buffer section in the loop in which buffer section the velocity of the sheets is changeable with respect to the remaining part of the paper path, and wherein the control unit is configured to determine the entrance time of each of the plurality of sheets for entering the loop in the paper path for the second pass by determining for each of the plurality of sheets a change in the velocity of the sheet when entering the at least one buffer section.

4. The printing system according to claim 1, wherein the pattern recognition module is configured to detect at least one tandem repeat in the plurality of sheets.

5. The printing system according to claim 1, wherein the pattern recognition module is configured to recognize a number of groups of media properties which number is limited to an expected number of different groups of media properties of sheets to be printed by the printing system.

6. The printing system according to claim 1, wherein the pattern recognition module is configured to receive a number of sheets in print order to be time scheduled which number is at least twice the maximum number of sheets which fits in the loop.

7. A method for time scheduling a plurality of sheets having different media properties in a loop of a printing system which comprises a control unit for controlling the printing of image data on the plurality of sheets and scheduling the plurality of sheets in a printing order, a paper path comprising the loop in order to enable printing on the plurality of sheets in an interweaving first and second pass in the loop, and a print head or print assembly for disposing marking material on the sheets according to the image data, wherein the method comprises the steps of:

recognizing an arbitrary repeating pattern in the plurality of sheets on the basis of the media properties of the sheets;

determining an entrance time of each of the plurality of sheets for entering the loop in the paper path for the first pass while taking the repeating pattern recognized by the pattern recognition module and a length of the loop into account;

determining an entrance time of each of the plurality of sheets for entering the loop in the paper path for the second pass while taking the arbitrary repeating pattern recognized by the pattern recognition module and a length of the loop into account; and printing the image data on the plurality of sheets in a first pass and a second pass through the loop, wherein each of the plurality of sheets enters the loop in the paper path for the first pass at the corresponding determined entrance time and enters the loop in the paper path for the second pass at the corresponding determined entrance time.

8. A software product comprising program code on a non-transitory computer-readable medium, wherein said program code, when loaded into a computer that is connected to a printing system causes the computer to act according to a method of claim 7.

* * * * *